US012185842B2

(12) United States Patent
Mittal et al.

(10) Patent No.: US 12,185,842 B2
(45) Date of Patent: Jan. 7, 2025

(54) ENCASEMENTS AND METHODS OF MANUFACTURE

(71) Applicant: Sysco Guest Supply, LLC, Somerset, NJ (US)

(72) Inventors: Khushboo Mittal, Chatham, NJ (US); Behnoosh Ghaani Farashahi, Piscataway, NJ (US); Sujha Balaji, Kendall Park, NJ (US); Richard Barter, Canton, GA (US)

(73) Assignee: Sysco Guest Supply, LLC, Somerset, NJ (US)

( * ) Notice: Subject to any disclaimer, the term of this patent is extended or adjusted under 35 U.S.C. 154(b) by 0 days.

(21) Appl. No.: 18/129,986

(22) Filed: Apr. 3, 2023

(65) Prior Publication Data

US 2023/0232997 A1 Jul. 27, 2023

Related U.S. Application Data

(63) Continuation of application No. 17/072,182, filed on Oct. 16, 2020, now Pat. No. 11,627,814.

(51) Int. Cl.
*A47C 31/00* (2006.01)
*A47C 31/10* (2006.01)
(Continued)

(52) U.S. Cl.
CPC ..... *A47C 31/105* (2013.01); *A47C 31/007* (2013.01); *A47C 27/005* (2013.01); *A47G 2009/001* (2013.01); *A47G 9/0238* (2013.01)

(58) Field of Classification Search
CPC ..... A47C 31/00; A47C 31/10; A47C 31/105; A47C 31/007; A47C 27/005; A47G 9/00;
(Continued)

(56) References Cited

U.S. PATENT DOCUMENTS 3,292,748 A * 12/1966 Rifkin ..... A45C 3/00 190/125
4,397,378 A * 8/1983 Lee ..... A45C 3/001 190/119
(Continued)

FOREIGN PATENT DOCUMENTS

CN 201328948 Y 10/2009
CN 202775304 U 3/2013
(Continued)

OTHER PUBLICATIONS

International Search Report and Written Opinion for International Application No. POTIUS2021/055217, report mail date Feb. 2, 2022; pp. 1-13.
(Continued)

*Primary Examiner* — Fredrick C Conley
(74) *Attorney, Agent, or Firm* — Lowenstein Sandler LLP

(57) ABSTRACT

An encasement for protecting a household item from bug intrusion includes a fabric cover having an elongated opening with a first end location and a second end location, the fabric cover being of a size for receiving the household item in the interior of the cover, a zipper configured to seal the opening, a first inside securing member attached inside the fabric cover along a first edge of the elongated opening, the first inside securing member comprising hook or loop fasteners, a second inside securing member attached inside the fabric cover along a second edge of the elongated opening, the second inside securing member including hook or loop fasteners, and an inside patch comprising the other of the hook or loop fasteners, the inside patch configured to be attached to the first inside securing member and the second inside securing member when the zipper is closed.

20 Claims, 4 Drawing Sheets

(51) Int. Cl.
*A47C 27/00* (2006.01)
*A47G 9/00* (2006.01)
*A47G 9/02* (2006.01)

(58) Field of Classification Search
CPC ... A47G 9/02; A47G 9/0238; A47G 2009/001
See application file for complete search history.

(56) References Cited

U.S. PATENT DOCUMENTS

| | | | | |
|---|---|---|---|---|
| 4,815,176 | A | 3/1989 | Yoshida | |
| 7,552,489 | B2 | 6/2009 | Bell et al. | |
| 7,849,543 | B2 | 12/2010 | Poston, Jr. et al. | |
| 8,087,111 | B2 | 1/2012 | Paris | |
| 8,413,276 | B2 | 4/2013 | Rattner et al. | |
| 8,429,777 | B2 | 4/2013 | Svoboda | |
| 8,516,633 | B2 | 8/2013 | Dobin | |
| 8,528,134 | B2 | 9/2013 | Bell et al. | |
| 8,615,826 | B2 | 12/2013 | Michael | |
| 8,806,678 | B2 | 8/2014 | Michael | |
| 9,179,783 | B2 | 11/2015 | Snell et al. | |
| 10,463,167 | B2 | 11/2019 | Rabbany et al. | |
| 2007/0113384 | A1* | 5/2007 | Ortlieb | A44B 19/32 24/385 |
| 2008/0196217 | A1* | 8/2008 | Eschbach | A44B 19/262 24/386 |
| 2011/0067182 | A1 | 3/2011 | Kussoff | |
| 2011/0099714 | A1 | 5/2011 | Svoboda | |
| 2011/0162140 | A1 | 7/2011 | Paris | |
| 2012/0084918 | A1 | 4/2012 | Rattner et al. | |
| 2012/0102646 | A1* | 5/2012 | Chen | A44B 19/22 112/475.17 |
| 2012/0167307 | A1* | 7/2012 | Michael | A47C 31/105 5/501 |
| 2012/0255120 | A1* | 10/2012 | Poston | A47C 31/007 5/499 |
| 2013/0117935 | A1* | 5/2013 | Rensink | A47C 31/007 5/499 |
| 2015/0096122 | A1* | 4/2015 | Rabbany | A47C 31/007 5/490 |
| 2015/0182042 | A1 | 7/2015 | Jensen et al. | |
| 2016/0331160 | A1* | 11/2016 | Rattner | A47C 31/105 |
| 2017/0119171 | A1* | 5/2017 | Levinsohn | A47C 31/007 |
| 2017/0295892 | A1 | 10/2017 | Goldberg et al. | |
| 2017/0367490 | A1 | 12/2017 | Fischer et al. | |

FOREIGN PATENT DOCUMENTS

| | | |
|---|---|---|
| CN | 207220611 Y | 4/2018 |
| CN | 211298695 U | 8/2020 |
| ES | 1068068 U | 8/2008 |

OTHER PUBLICATIONS

Bug Lock Mechanisms: Bed bug Solutions—Hybrid—Zippered Velcro encasements; pp. 1-13.

First Office Action and Search Report for Chinese Patent Application Serial No. 202180078531.0 dated Dec. 23, 2023, in Chinese and English, 14 pages.

* cited by examiner

ENCASEMENTS AND METHODS OF MANUFACTURE

CROSS REFERENCE TO RELATED APPLICATIONS

This application is a continuation of and claims priority to U.S. patent application Ser. No. 17/072,182, titled "Encasements and Methods of Manufacture," filed on Oct. 16, 2020, the entire contents of which is incorporated herein by reference.

TECHNICAL FIELD

Embodiments generally relate to encasements for protecting household items from bug intrusion. More specifically, embodiments relate to encasements and their methods of manufacture.

BACKGROUND

Bed bugs are a type of insect that commonly hide within bed mattresses. Such bed bugs are found in motels, hostels, or boarding houses where itinerant travelers find overnight lodging. Bed bugs feed off of the blood of humans sleeping on the mattresses that harbor these insects. Typically, a bed bug will crawl out of the mattress during the night, bite the sleeping victim, and then return to the safe confines of the mattress.

To prevent the escapement of bed bugs from the mattress, and thus contain and starve the bugs, a technique has been devised in which the mattress is surrounded with a fabric cover or encasement to seal the exit of the bugs. The encasement is slipped onto the mattress and closed via a slide fastening mechanism such as a zipper. Bugs escaping from the mattress will encounter the barrier of the fabric cover, and thus will be prevented from reaching a human sleeping on the mattress.

Problems exist, however, with the use of such protective mattress covers or encasements. For example, a user may fail to completely close the zipper on the encasement, or the zipper may become partially unzipped through movement or rustling of the mattress, as for example, when the bed is made and remade. This results in an opening at the zipper end through which bed bugs may escape. Indeed, even zippers that have been carefully and completely closed may still leave a narrow opening at the end of the zipper that is a large enough opening for a small bed bug to crawl through and escape.

Accordingly, there exists a need to prevent bed bugs from entering a zipper opening in a mattress protective encasement.

SUMMARY

Accordingly, one example embodiment is an encasement for protecting a household item, such as a mattress or box spring, from bug intrusion and liquid spills. The encasement includes a fabric cover having an elongated opening with a first end location and a second end location, the fabric cover being of a size for receiving the household item in the interior of the cover. The encasement further includes a zipper configured to seal the opening, the zipper including a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the zipper head in either direction, wherein a first zipper track is attached to a first edge of the elongated opening of the fabric cover, and a second zipper track is attached to a second edge of the elongated opening of the fabric cover. The encasement further includes a first inside securing member attached inside the fabric cover along the first edge of the elongated opening, the first inside securing member including hook or loop fasteners, a second inside securing member attached inside the fabric cover along the second edge of the elongated opening, the second inside securing member including hook or loop fasteners, and an inside patch including the other of the hook or loop fasteners, the inside patch configured to be attached to at least a substantial portion of the first inside securing member and the second inside securing member when the zipper is closed.

The encasement may also include a plurality of flaps attached to the fabric cover on one side of the elongated opening, wherein the plurality of flaps include a hook or loop fasteners attached to an inside of the flaps, a plurality of first outside securing members including the other of hook or loop fasteners, the plurality of first outside securing members attached to the fabric cover on the one side of the elongated opening, and a plurality of second outside securing members including the other of hook or loop fasteners, the plurality of second outside securing members attached to the fabric cover on the other side of the elongated opening, the plurality of first outside securing members and the plurality of second outside securing members together configured to secure the plurality of flaps when closed.

Another example embodiment is a method of making an encasement for protecting a household item from bug intrusion and liquid spills. The method includes providing a fabric cover having an elongated opening with a first end location and a second end location, the fabric cover being of a size for receiving the household item in the interior of the cover. The method further includes attaching a zipper to the elongated opening of the fabric cover, the zipper configured to completely seal the opening, the zipper including a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the zipper head in either direction, wherein a first zipper track is attached to a first edge of the elongated opening of the fabric cover, and a second zipper track is attached to a second edge of the elongated opening of the fabric cover. The method further includes attaching a first inside securing member to the inside of the fabric cover along the first edge of the elongated opening, the first inside securing member including hook or loop fasteners. The method further includes attaching a second inside securing member to the inside of the fabric cover along the second edge of the elongated opening, the second inside securing member including hook or loop fasteners. The method further includes providing an inside patch including the other of the hook or loop fasteners, the inside patch configured to be attached to at least a substantial portion of the first inside securing member and the second inside securing member when the zipper is closed.

In one embodiment, the method may include attaching a plurality of flaps to the fabric cover on one side of the elongated opening, wherein the plurality of flaps include a hook or loop fasteners attached to an inside of the flaps. The method may also include attaching a plurality of first outside securing members to the fabric cover on the one side of the elongated opening, the plurality of first outside securing members including the other of hook or loop fasteners, and attaching a plurality of second outside securing members to the fabric cover on the one side of the elongated opening, the plurality of second outside securing members including the other of hook or loop fasteners, the plurality of first outside securing members and the plurality of second outside securing members together configured to secure the plurality of flaps when closed.

Another example embodiment is a mattress encasement for protecting a mattress from bug intrusion and liquid spills. The mattress encasement includes a fabric cover having an elongated opening with a first end location and a second end location, the fabric cover being of a size for receiving the household item in the interior of the cover. The mattress encasement includes a zipper configured to seal the opening, the zipper including a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the zipper head in either direction, wherein a first zipper track is attached to a first edge of the elongated opening of the fabric cover, and a second zipper track is attached to a second edge of the elongated opening of the fabric cover. The mattress encasement further includes a first inside securing member attached inside the fabric cover along the first edge of the elongated opening, the first inside securing member including hook or loop fasteners, a second inside securing member attached inside the fabric cover along the second edge of the elongated opening, the second inside securing member including hook or loop fasteners, and an inside patch including the other of the hook or loop fasteners, the inside patch configured to be attached to at least a substantial portion of the first inside securing member and the second inside securing member when the zipper is closed.

In one embodiment, the mattress encasement may include a plurality of flaps attached to the fabric cover on one side of the elongated opening, wherein the plurality of flaps include a hook or loop fasteners attached to an inside of the flaps. The mattress encasement may also include a plurality of first outside securing members including the other of hook or loop fasteners, the plurality of first outside securing members attached to the fabric cover on the one side of the elongated opening, and a plurality of second outside securing members including the other of hook or loop fasteners, the plurality of second outside securing members attached to the fabric cover on the other side of the elongated opening, the plurality of first outside securing members and the plurality of second outside securing members together configured to secure the plurality of flaps when closed.

BRIEF DESCRIPTION OF THE DRAWINGS

So that the manner in which the features, advantages and objects of the invention, as well as others which may become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and is therefore not to be considered limiting of its scope as the invention may admit to other equally effective embodiments.

DETAILED DESCRIPTION

The methods and encasements of the present disclosure can now be described more fully hereinafter with reference to the accompanying drawings in which embodiments are shown. The methods and encasements of the present disclosure may be in many different forms and should not be construed as limited to the illustrated embodiments set forth herein; rather, these embodiments are provided so that this disclosure can be thorough and complete, and can fully convey its scope to those skilled in the art. Like numbers refer to like elements throughout.

Figure 1:
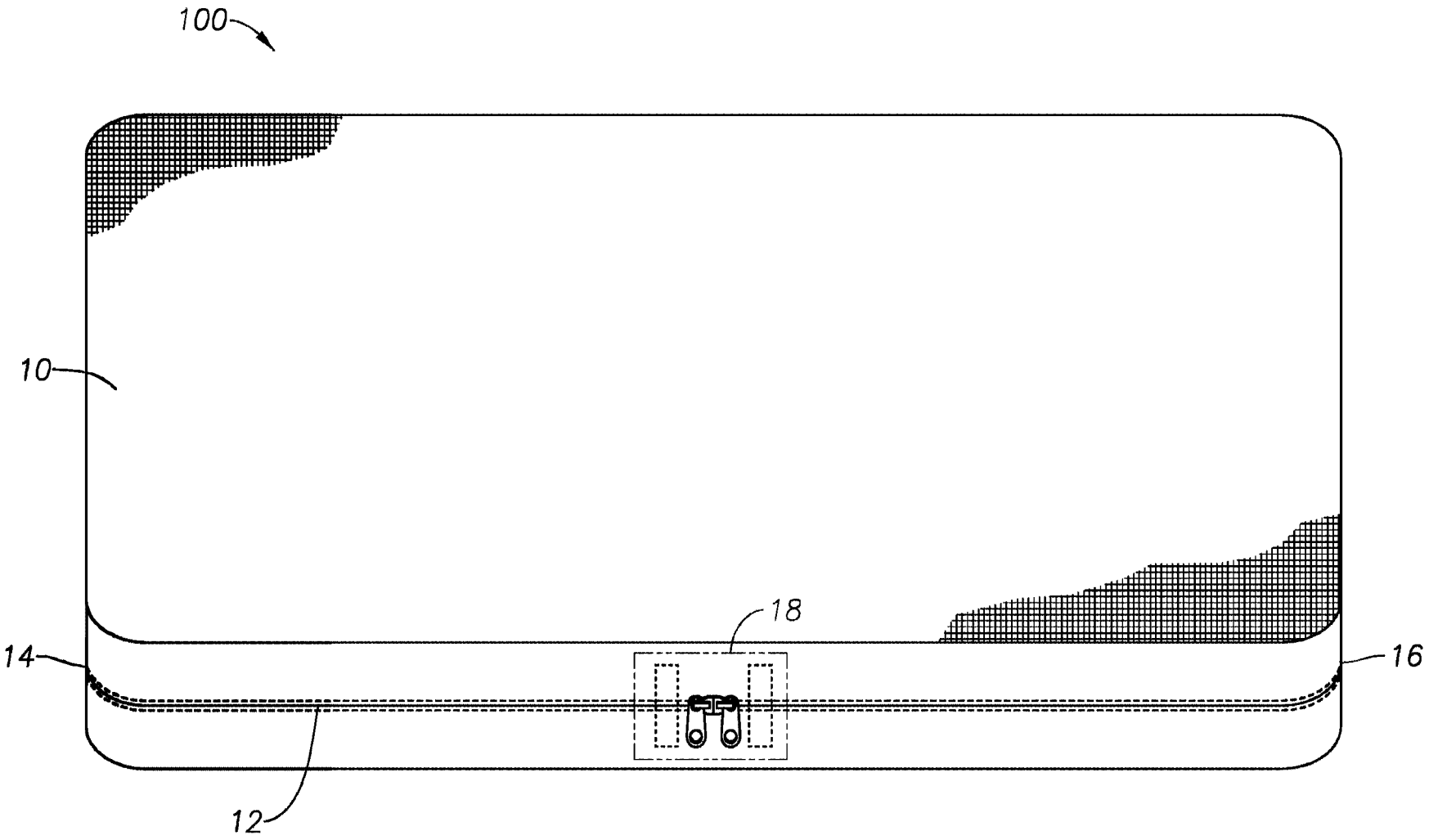
FIG. 1 is a perspective view of a mattress encasement, according to one example embodiment of the disclosure.

Turning now to the figures, FIG. 1 is a perspective view of an encasement 100 for protecting a household item, such as a mattress or box spring, from bug intrusion and liquid spills, according to one example embodiment of the disclosure. Although a mattress is used as an example in some embodiments, the invention is not limited to use on a mattress, and may be used on any household item such as a sofa, box spring, suitcase, pillows, or any household item that may be prone to bug intrusion or liquid spills. As illustrated, the encasement 100 includes a fabric cover 10 having an elongated opening 12 with a first end location 14 and a second end location 16. The fabric cover 10 has an appropriate size, including length, width, and height, for receiving the household item, such as the mattress, in the interior of the cover 10.

Figure 2:
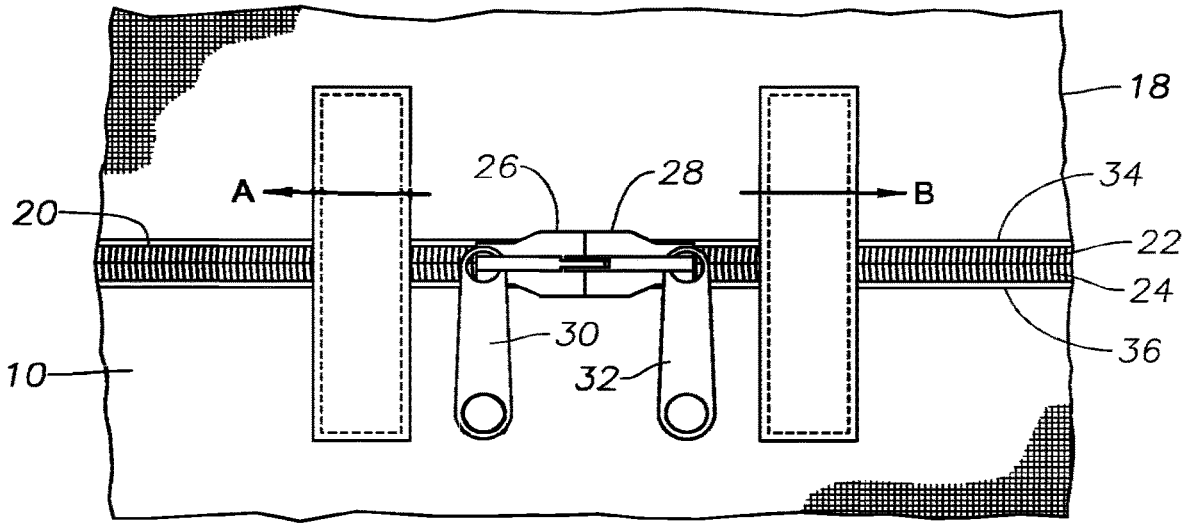
FIG. 2 illustrates a close-up view of an encasement for protecting a household item from bug intrusion, according to one example embodiment of the disclosure.

FIG. 2 illustrates a close-up view of portion 18 (shown in FIG. 1) of the encasement 100 for protecting a household item from bug intrusion and liquid spills, according to one example embodiment of the disclosure. As illustrated, encasement 100 further includes a zipper 20 configured to completely seal the opening 12. The zipper 20 includes a plurality of zipper tracks 22, 24, and a zipper head 26 configured to open the zipper 20 in a first direction 'A' and close the zipper 20 in a second direction 'B'. The zipper further includes a second zipper head 28 configured to open the zipper 20 in the second direction 'B' and close the zipper in the first direction 'A', as illustrated by arrows in directions A and B. The first zipper head 26 and the second zipper head 28 each have a zipper pull 30, 32, respectively, to pull the zipper head in either direction. The first zipper track 22 is attached to a first edge 34 of the elongated opening 12 of the fabric cover 10. The second zipper track 24 is attached to a second edge 36 of the elongated opening 12 of the fabric cover 10.

Figure 3:
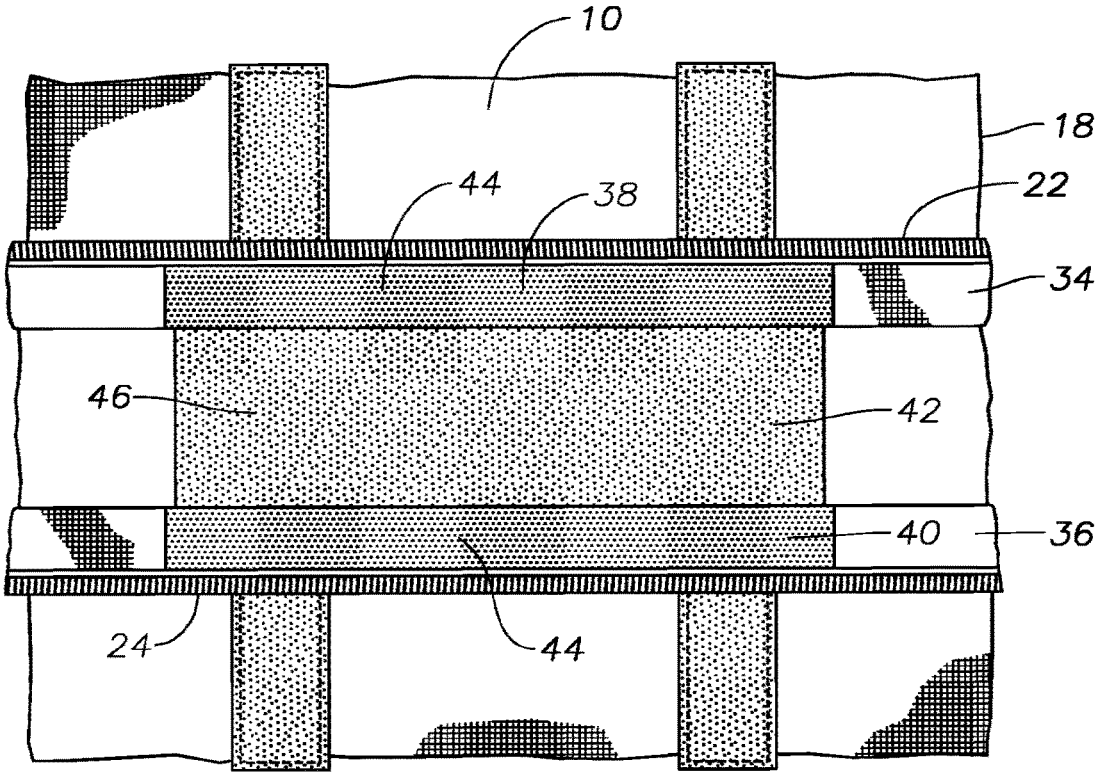
FIG. 3 illustrates another close-up view of an encasement for protecting a household item from bug intrusion, according to one example embodiment of the disclosure.

Turning now to FIG. 3, the encasement 100 further includes a first inside securing member 38 attached inside the fabric cover 10 along the first edge 34 of the elongated opening 12. The first inside securing member 38 may include a hook or loop type fastener 44, such as Velcro®. The encasement may further include a second inside securing member 40 attached inside the fabric cover 10 along the second edge 36 of the elongated opening 12. The second inside securing member 40 may also include a hook or loop fastener 44, such as Velcro®. The encasement 100 may further include an inside patch 42 including the other of the hook or loop type fastener 46. For example, if members 38 and 40 include the hooks, then the inside patch would include the loop type fastener, and vice versa. The inside patch 42 may be configured, in size and shape, to be attached to at least a substantial portion of the first inside securing member 38 and the second inside securing member 40 when the zipper 20 is closed. In one embodiment, the inside patch 42 may have a fabric backing and the hook or loop type fastener may be attached to the fabric backing. The fabric backing may be made of the same material as the fabric cover or it may be made of another material suitable for the purpose. In another embodiment, the fabric backing may surround the perimeter of the inside patch 42 and partially overlap the hook or loop type fasteners on the front such that the inside patch 42 has smooth edges. The inside patch 42 may be attached inside the fabric cover 10, along the first edge 34 or the second edge 36, on either sides of the elongated opening 12.

Figure 4:
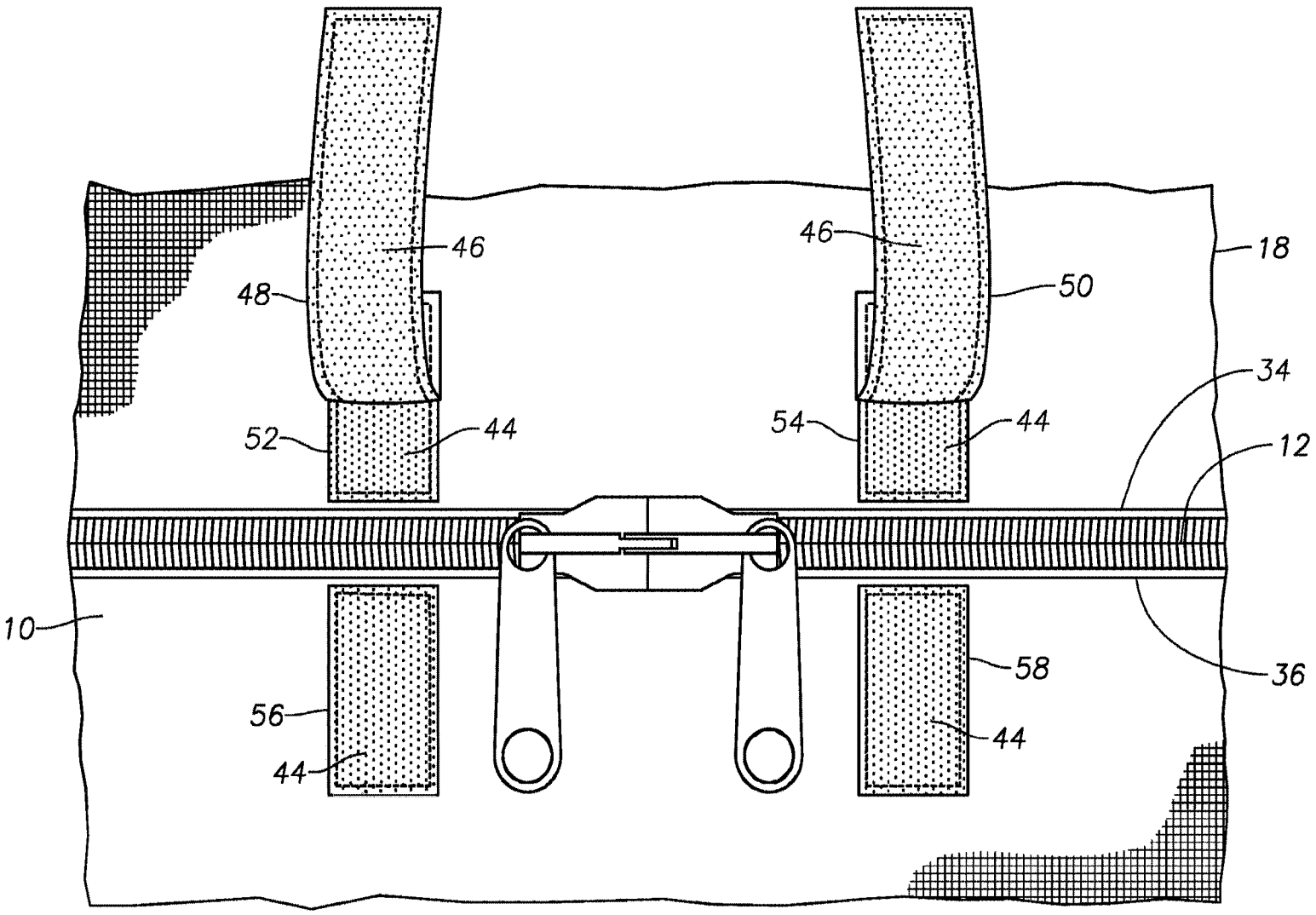
FIG. 4 illustrates yet another close-up view of an encasement for protecting a household item from bug intrusion, according to some example embodiments of the disclosure.

As illustrated in FIG. 4, the encasement 100 may also include a plurality of flaps 48, 50 attached to the fabric cover 10 on one side of the elongated opening 12. The plurality of flaps 48, 50 may include a hook or loop type fastener 46 attached to an inside of the flaps 48, 50. The encasement 100 may further include a plurality of first outside securing members 52, 54 including the other of hook or loop fasteners 44. The plurality of first outside securing members 52, 54 may be attached to the fabric cover 10 on one side of the elongated opening 12. The encasement 100 may further include a plurality of second outside securing members 56, 58 including the other of hook or loop fasteners 44. The plurality of second outside securing members 56, 58 may be attached to the fabric cover 10 on the other side of the elongated opening 12. As illustrated in FIG. 4, the plurality of first outside securing members 52, 54 and the plurality of second outside securing members 56, 58 together secure the plurality of flaps when closed 48, 50. In one embodiment, the fabric cover 10 and the flaps 48, 50 may be formed of a bug impervious material, such as a bug impervious fabric.

Figure 5:
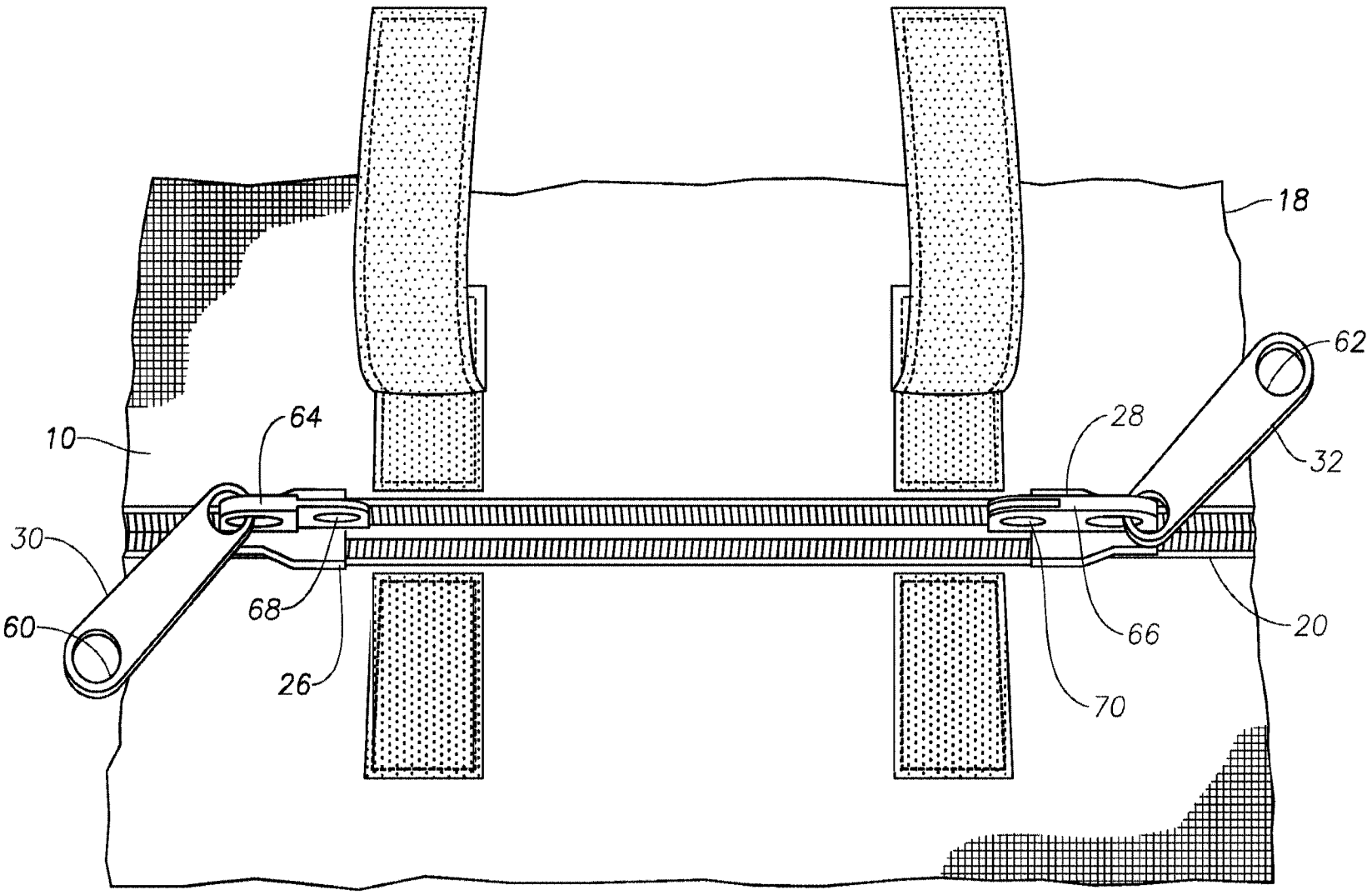
FIG. 5 illustrates yet another close-up view of an encasement for protecting a household item from bug intrusion, according to one example embodiment of the disclosure.

FIG. 5 illustrates a close-up view of the zipper arrangement 20 on the encasement 100 for protecting a household item from bug intrusion and liquid spills, according to one example embodiment of the disclosure. In this embodiment, the zipper pulls 30, 32 each have an aperture or eye 60, 62, configured to lock the zipper pulls 30, 32 together using a locking means. In one embodiment, the zipper heads 26, 28 each include an arch shaped lug 64, 66 configured to secure the zipper pull 30, 32, and another aperture or eye 68, 70 configured to lock the zipper heads 26, 28 together using a locking means. The locking means may include at least one of an anchor tie, a mechanical locking means, and an electronic locking means.

In one embodiment a fabric weight of the fabric cover 10 is in the range of about 10 gsm to 1000 gsm, with a preferred range of about 40 gsm to 200 gsm. The fabric cover 10 may include at least one of cotton, polyester, nylon, spandex, acetate, Kevlar, Nomex, and rayon yarns in either warp or weft direction. For example, in one embodiment, the fabric cover 10 may include 100% polyester yarns in both warp and weft directions, or if the structure is a knit structure, then the fabric cover 10 may include 100% polyester yarns in the knit structure. In a preferred embodiment, the fabric cover 10 is anti-microbial and water proof. As to the structure of the fabric itself, the fabric cover 10 may include at least one of a woven, knitted, nonwoven, and an extruded base. For example, the fabric cover 10 may include about 95 gsm polyester knit fabric and 35 gsm of a thermoplastic polyurethane (TPU) coating or lamination. The yarn density of the yarn used to manufacture the fabric cover 10 may be the range of about 25 D to 500 D, with a preferred range of about 75 D to 150 D.

Another example embodiment is a method of making an encasement for protecting a household item from bug intrusion and liquid spills. The method includes providing a fabric cover having an elongated opening with a first end location and a second end location, the fabric cover being of a size for receiving the household item in the interior of the cover. The method further includes attaching a zipper to the elongated opening of the fabric cover, the zipper configured to completely seal the opening, the zipper including a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the zipper head in either direction, wherein a first zipper track is attached to a first edge of the elongated opening of the fabric cover, and a second zipper track is attached to a second edge of the elongated opening of the fabric cover. The method further includes attaching a first inside securing member to the inside of the fabric cover along the first edge of the elongated opening, the first inside securing member including hook or loop fasteners. The method further includes attaching a second inside securing member to the inside of the fabric cover along the second edge of the elongated opening, the second inside securing member including hook or loop fasteners. The method further includes providing an inside patch including the other of the hook or loop fasteners, the inside patch configured to be attached to at least a substantial portion of the first inside securing member and the second inside securing member when the zipper is closed.

In one embodiment, the method may include attaching a plurality of flaps to the fabric cover on one side of the elongated opening, wherein the plurality of flaps include a hook or loop fasteners attached to an inside of the flaps. The method may also include attaching a plurality of first outside securing members to the fabric cover on the one side of the elongated opening, the plurality of first outside securing members including the other of hook or loop fasteners, and attaching a plurality of second outside securing members to the fabric cover on the one side of the elongated opening, the plurality of second outside securing members including the other of hook or loop fasteners, the plurality of first outside securing members and the plurality of second outside securing members together configured to secure the plurality of flaps when closed.

Another example embodiment is a mattress encasement for protecting a mattress from bug intrusion and liquid spills. The mattress encasement includes a fabric cover having an elongated opening with a first end location and a second end location, the fabric cover being of a size for receiving the household item in the interior of the cover. The mattress encasement includes a zipper configured to seal the opening, the zipper including a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the zipper head in either direction, wherein a first zipper track is attached to a first edge of the elongated opening of the fabric cover, and a second zipper track is attached to a second edge of the elongated opening of the fabric cover. The mattress encasement further includes a first inside securing member attached inside the fabric cover along the first edge of the elongated opening, the first inside securing member including hook or loop fasteners, a second inside securing member attached inside the fabric cover along the second edge of the elongated opening, the second inside securing member including hook or loop fasteners, and an inside patch including the other of the hook or loop fasteners, the inside patch configured to be attached to at least a substantial portion of the first inside securing member and the second inside securing member when the zipper is closed.

In one embodiment, the mattress encasement may include a plurality of flaps attached to the fabric cover on one side of the elongated opening, wherein the plurality of flaps include a hook or loop fasteners attached to an inside of the flaps. The mattress encasement may also include a plurality of first outside securing members including the other of hook or loop fasteners, the plurality of first outside securing members attached to the fabric cover on the one side of the elongated opening, and a plurality of second outside securing members including the other of hook or loop fasteners, the plurality of first outside securing members attached to the fabric cover on the other side of the elongated opening, the plurality of first outside securing members and the plurality of second outside securing members together configured to secure the plurality of flaps when closed.

The present embodiment may also be expressed as a method of making a bed bug retardant mattress, including laminating a polyester interlock knit with a polyurethane film to form a bed bug retardant layer; quilting the bed bug retardant layer to a fire retardant layer and to a foam layer; and joining an inner section to the quilted bed bug retardant layer form a mattress.

The encasement of the invention uses materials that satisfy various testing requirements. The encasement 1 uses a YKK zipper 2 and meets certain ASTM testing requirements as follows: ASTM D4034 Seam Slippage Test—ACT standards call for a minimum of 25 pounds in warp and weft. The encasement of the invention exceeds those standards by using a self-imposed minimum of 35 pounds in warp and weft for that test. ASTM D2261 Tongue Tear Test—Minimum of 8 pounds. ASTM D5034 Tensile Strength/Breaking strength test—Minimum 25 pounds FR code of California bulletin 117 is met or exceeded. ASTM D5362 Bean Bag Snag test is met or exceeded. AATCC 8 Wet/Dry Crocking—The encasement of the invention meets or exceeds a 4.0 for dry and a 3.5 rating for wet crocking. ASTM D3512 Random Tumble Pill test—Fabrics meet or exceed a rating of 4.0. AATCC 96-2004 Dimensional Changes in laundering—The encasement of the invention has less than 3% shrinking after 3 launderings.

The preferred embodiment of the new mattress cover is constructed of polyester knit fabric and urethane laminate that is impervious to penetration or passage therethrough by bed bugs and liquids; however other fabrics may be used if they are bed bug proof against bed bugs feeding through, biting through or traveling through the fabric. Conventional zippers may be used, so long as they too are bed bug proof. The attachments strips are preferably vinyl sheet material, but other materials are acceptable they are suitable for releasable attachable to the external barrier flap. The external barrier flap is preferably a conventional fabric tape with an adhesive material or coating on one side and a peel-off protection sheet on the adhesive side.

The above-described mattress cover structures provide apparatus embodiments of the present invention, which can also be defined as a method of achieving secure releasable closure against exit of bed bugs from within a mattress cover.

Such method, with a mattress cover having a zipper closed opening, includes the steps: a. providing generally flat attachment strips on the outer surfaces of the mating zipper tracks near their closure end, b. providing an external barrier flap with a first part thereof fixed to said cover near said zipper closure end, with a main part thereof extending from said first part and situated in its open position spaced apart from said zipper closure end, where said main part has one adhesive surface covered by a peel-off protective sheet, c. closing said zipper, after inserting a mattress within said cover, by moving the zipper pull to the closure ends of said tracks, and d. removing said peel-off protective sheet and folding said main part adhesive surface down onto said attachment strips for sealing said zipper closure.

The encasement 100 including the encasement seal generally restricts bed bugs from entering the encasement 100 or exiting therefrom at the zipper end locations 14, 16. Another advantage of the encasement is that because an encasement seal (not shown) can be provided outside of the cover 10, it does not interfere with opening and closing of the zipper 20. The cutout of the base frames the zipper 20 near the end location 14, 16 to allow the zipper 20 to move freely.

Still another advantage of the encasement 100 is that an encasement seal can have a low profile so that standard sheet sets have no problem sliding over the encasement seal. Further, unlike foam components or hooks that may break or degrade over time, the hook and loop fastener of the encasement seal will remain functional over a long period of time. Another advantage is that the flaps 48, 50 provide a good location for printing information about the encasement cover, such as encasement cover size, for example. In large hotels, this feature allows house-keeping staff to quickly locate encasement covers of a particular size.

It will be appreciated by a person skilled in the art that although the encasement 100 has been described as receiving a mattress, the encasement 100 may alternatively receive a box spring. Further, the encasement 100 may be provided in different sizes and shapes for use with mattresses, box springs, couch cushions, chair cushions, pillows and duvets, for example, or any stuffed or filled article (whether stuffed or filled by natural or man-made materials).

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "operatively connecting" and its conjugated forms means to complete any type of required junction, including electrical, mechanical or fluid, to form a connection between two or more previously non-joined objects. If a first component is operatively connected to a second component, the connection can occur either directly or through a common connector. "Optionally" and its various forms means that the subsequently described event or circumstance may or may not occur. The description includes instances where the event or circumstance occurs and instances where it does not occur.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The encasements and methods described herein, therefore, are well adapted to carry out the objects and attain the ends and advantages mentioned, as well as others inherent therein. While example embodiments of the encasement and method have been given for purposes of disclosure, numerous changes exist in the details of procedures for accomplishing the desired results. These and other similar modifications may readily suggest themselves to those skilled in the art, and are intended to be encompassed within the spirit of the encasement and method disclosed herein and the scope of the appended claims.

What is claimed is:

1. An encasement for protecting a household item from bug intrusion or liquid spills, the encasement comprising:

a fabric cover having an elongated opening with a first end location and a second end location, the fabric cover being of a size for receiving the household item in interior of the fabric cover;

a zipper configured to seal the opening, the zipper comprising a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the first zipper head and the second zipper head in either direction, wherein a first zipper track is attached to a first edge of the elongated opening of the fabric cover, and a second zipper track is attached to a second edge of the elongated opening of the fabric cover;

a first inside securing member attached inside the fabric cover along the first edge of the elongated opening, the first inside securing member comprising a first set of first hook or loop fasteners;

a second inside securing member attached inside the fabric cover along the second edge of the elongated opening, the second inside securing member comprising a second set of the first hook or loop fasteners;

an inside patch comprising the other of the first hook or loop fasteners, the inside patch configured to be attached to at least a substantial portion of the first inside securing member and the second inside securing member when the zipper is closed; and a plurality of flaps attached to the fabric cover on a first side of the elongated opening, wherein the plurality of flaps comprise;

a first flap attached to the fabric cover on the first side of the elongated opening, the first flap comprising a first set of second hook or loop fasteners attached to a first inside of the first flap; and a second flap attached to the fabric cover on the first side of the elongated opening, the second flap comprising a second set of the second hook or loop fasteners attached to a second inside of the second flap, wherein the plurality of flaps are configured to secure to the fabric cover at a second side of the elongated opening.

2. The encasement of claim 1, further comprising:

a plurality of first outside securing members comprising a first set of the other of the second hook or loop fasteners, the plurality of first outside securing members attached to the fabric cover on the first side of the elongated opening; and a plurality of second outside securing members comprising a second set of the other of the second hook or loop fasteners, the plurality of second outside securing members attached to the fabric cover on the second side of the elongated opening, the plurality of first outside securing members and the plurality of second outside securing members together configured to secure the plurality of flaps when closed, the second side of the elongated opening being opposite the first side of the elongated opening, the elongated opening being formed between the first side of the elongated opening and the second side of the elongated opening.

3. The encasement of claim 1, wherein the fabric cover comprises a bug or liquid impervious fabric.

4. The encasement of claim 1, wherein the flaps are formed of a bug impervious material.

5. The encasement of claim 1, wherein the zipper pulls each have a first aperture or eye configured to lock the zipper pulls together using a locking means.

6. The encasement of claim 1, wherein the first zipper head and the second zipper head each comprise an arch shaped lug configured to secure the zipper pull, and a second aperture or eye configured to lock the first zipper head and the second zipper head together using a locking means.

7. The encasement of claim 6, wherein the locking means comprises at least one of an anchor tie, a mechanical locking means, and an electronic locking means.

8. The encasement of claim 1, wherein a fabric weight of the fabric cover is in a range of about 10 gsm to 1000 gsm.

9. The encasement of claim 1, wherein the fabric cover comprises at least one of cotton, polyester, nylon, or rayon yarns in either warp or weft direction.

10. The encasement of claim 9, wherein yarn density is a range of about 25 D to 500 D.

11. The encasement of claim 1, wherein the fabric cover is anti-microbial and water proof.

12. The encasement of claim 1, wherein the fabric cover comprises at least one of a woven, knitted, nonwoven, and an extruded base.

13. The encasement of claim 1, wherein the fabric cover comprises about 95 gsm polyester knit fabric and 35 gsm of a thermoplastic polyurethane (TPU) coating or lamination.

14. The encasement of claim 1, wherein the fabric cover comprises 100% polyester yarns.

15. A method of making an encasement for protecting a household item from bug intrusion or liquid spills, the method comprising:

providing a fabric cover having an elongated opening with a first end location and a second end location, the fabric cover being of a size for receiving the household item in interior of the fabric cover;

attaching a zipper to the elongated opening of the fabric cover, the zipper configured to completely seal the opening, the zipper comprising a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the first zipper head and the second zipper head in either direction, wherein a first zipper track is attached to a first edge of the elongated opening of the fabric cover, and a second zipper track is attached to a second edge of the elongated opening of the fabric cover;

attaching a first inside securing member to an inside of the fabric cover along the first edge of the elongated opening, the first inside securing member comprising a first set of first hook or loop fasteners;

attaching a second inside securing member to the inside of the fabric cover along the second edge of the elongated opening, the second inside securing member comprising a second set of the first hook or loop fasteners;

providing an inside patch comprising the other of the first hook or loop fasteners, the inside patch configured to be attached to at least a substantial portion of the first inside securing member and the second inside securing member when the zipper is closed; and attaching a plurality of flaps to the fabric cover on a first side of the elongated opening, wherein the plurality of flaps comprise:

a first flap attached to the fabric cover on the first side of the elongated opening, the first flap comprising a first set of second hook or loop fasteners attached to a first inside of the first flap; and a second flap attached to the fabric cover on the first side of the elongated opening, the second flap comprising a second set of the second hook or loop fasteners attached to a second inside of the second flap, wherein the plurality of flaps are configured to secure to the fabric cover at a second side of the elongated opening.

16. The method of claim 15, further comprising:

attaching a plurality of first outside securing members to the fabric cover on the first side of the elongated opening, the plurality of first outside securing members comprising a first set of the other of the second hook or loop fasteners; and attaching a plurality of second outside securing members to the fabric cover on the second side of the elongated opening, the plurality of second outside securing members comprising a second set of the other of the second hook or loop fasteners, the plurality of first outside securing members and the plurality of second outside securing members together configured to secure the plurality of flaps when closed.

17. The method of claim 15, wherein the fabric cover comprises a bug or liquid impervious fabric.

18. The method of claim 15, wherein the flaps are formed of a bug impervious material.

19. An encasement for protecting a mattress or box spring from bug intrusion or liquid spills, the encasement comprising:

a fabric cover having an elongated opening with a first end location and a second end location, the fabric cover being of a size for receiving the mattress or the box spring in an interior of the fabric cover;

a zipper configured to seal the opening, the zipper comprising a plurality of zipper tracks, a first zipper head configured to open the zipper in a first direction and close the zipper in a second direction, a second zipper head configured to open the zipper in the second direction and close the zipper in the first direction, wherein the first zipper head and the second zipper head each have a zipper pull to pull the first zipper head and the second zipper head in either direction, wherein a first zipper track is attached to a first edge of the elongated opening of the fabric cover, and a second zipper track is attached to a second edge of the elongated opening of the fabric cover;

a first inside securing member attached inside the fabric cover along the first edge of the elongated opening, the first inside securing member comprising a first set of first hook or loop fasteners;

a second inside securing member attached inside the fabric cover along the second edge of the elongated opening, the second inside securing member comprising a second set of first hook or loop fasteners;

an inside patch comprising the other of the first hook or loop fasteners, the inside patch configured to be attached to at least a substantial portion of the first inside securing member and the second inside securing member when the zipper is closed; and a plurality of flaps attached to the fabric cover on a first side of the elongated opening, wherein the plurality of flaps comprise:

a first flap attached to the fabric cover on the first side of the elongated opening, the first flap comprising a first set of second hook or loop fasteners attached to a first inside of the first flap; and a second flap attached to the fabric cover on the first side of the elongated opening, the second flap comprising a second set of the second hook or loop fasteners attached to a second inside of the second flap, wherein the plurality of flaps are configured to secure to the fabric cover at a second side of the elongated opening.

20. The encasement of claim 19, further comprising:

a plurality of first outside securing members comprising a first set of the other of the second hook or loop fasteners, the plurality of first outside securing members attached to the fabric cover on the first side of the elongated opening; and a plurality of second outside securing members comprising a second set of the other of the second hook or loop fasteners, the plurality of second outside securing members attached to the fabric cover on the second side of the elongated opening, the plurality of first outside securing members and the plurality of second outside securing members together configured to secure the plurality of flaps when closed.

* * * * *